US007882827B2

(12) United States Patent
Grünenwald et al.

(10) Patent No.: US 7,882,827 B2
(45) Date of Patent: Feb. 8, 2011

(54) HEAT EXCHANGER FOR A COMBUSTION ENGINE

(75) Inventors: Bernd Grünenwald, Nürtingen (DE); Wolfgang Knödler, Waiblingen (DE)

(73) Assignee: BEHR GmbH & Co. KG, Stuttgart (DE)

( * ) Notice: Subject to any disclaimer, the term of this patent is extended or adjusted under 35 U.S.C. 154(b) by 255 days.

(21) Appl. No.: 12/093,481

(22) PCT Filed: Oct. 26, 2006

(86) PCT No.: PCT/EP2006/010343

§ 371 (c)(1),
(2), (4) Date: May 13, 2008

(87) PCT Pub. No.: WO2007/057099

PCT Pub. Date: May 24, 2007

(65) Prior Publication Data

US 2008/0271722 A1 Nov. 6, 2008

(30) Foreign Application Priority Data

Nov. 18, 2005 (DE) ..... 10 2005 055 481

(51) Int. Cl.
*F02M 25/07* (2006.01)
*F02B 47/08* (2006.01)
*F28D 7/16* (2006.01)
*F28F 21/08* (2006.01)

(52) U.S. Cl. ..... 123/568.12; 165/176; 165/180

(58) Field of Classification Search ..... 123/41.31, 123/563, 568.11, 568.12; 701/108; 60/320, 60/321, 599, 605.2; 165/172–177, 109.1, 165/134.1, 152, 153, 179, 180; 148/325–328
See application file for complete search history.

(56) References Cited

U.S. PATENT DOCUMENTS

| | | | | |
|---|---|---|---|---|
| 2,944,531 | A * | 7/1960 | Mary | 122/4 R |
| 4,418,859 | A * | 12/1983 | Devine, Jr. | 228/183 |
| 5,462,611 | A * | 10/1995 | Uematsu et al. | 148/325 |
| 6,786,210 | B2 * | 9/2004 | Kennedy et al. | 123/568.12 |
| 7,048,042 | B2 * | 5/2006 | Juschka | 165/173 |
| 2001/0047861 | A1 | 12/2001 | Maeda et al. | |
| 2003/0066631 | A1 | 4/2003 | Jayaweera et al. | |
| 2004/0050375 | A1 | 3/2004 | Arnold | |
| 2005/0056411 | A1 | 3/2005 | Dilley et al. | |
| 2007/0261400 | A1 * | 11/2007 | Digele et al. | 60/320 |
| 2008/0078536 | A1 * | 4/2008 | Tolani | 165/134.1 |

FOREIGN PATENT DOCUMENTS

DE 198 57 473 A1 11/1999

(Continued)

*Primary Examiner*—Willis R Wolfe, Jr.
(74) *Attorney, Agent, or Firm*—Foley & Lardner LLP

(57) ABSTRACT

Disclosed is a heat exchanger for a combustion engine, comprising a first connection zone (1, 102) for delivering a fluid that is to be cooled, at least some of said fluid being composed of exhaust gas of the combustion engine, a second connection zone (3, 103) for discharging the fluid, and an exchanger zone (2, 101, 104, 105) which is arranged between the first and the second connection zone relative to a flow path of the fluid. A coolant can flow around the exchanger zone (2, 101, 104, 105) while at least part of the heat exchanger is made of ferritic steel.

29 Claims, 2 Drawing Sheets

FOREIGN PATENT DOCUMENTS

| | | | | | |
|---|---|---|---|---|---|
| EP | 1 411 315 | A1 | | 4/2004 | |
| GB | 2 017 761 | A | | 10/1979 | |
| GB | 2 417 067 | A | | 2/2006 | |
| JP | 4-63989 | U | | 6/1882 | |
| JP | 61-70532 | A | | 4/1986 | |
| JP | 61235542 | A | * | 10/1986 | ..... 148/325 |
| JP | 01158399 | A | * | 6/1989 | ..... 60/320 |
| JP | 4-63988 | U | | 6/1992 | |
| JP | 6-170532 | A | | 6/1994 | |
| JP | 2002-028775 | A | | 1/2002 | |
| JP | 2002-106970 | A | | 4/2002 | |
| JP | 2002106970 | A | * | 4/2002 | ..... 165/173 |
| JP | 2003-222498 | A | | 8/2003 | |
| JP | 2003-278609 | A | | 10/2003 | |
| JP | 2004-084959 | A | | 3/2004 | |
| JP | 2005-55153 | A | | 3/2005 | |
| JP | 2005-055153 | A | | 3/2005 | |

* cited by examiner

HEAT EXCHANGER FOR A COMBUSTION ENGINE

The invention relates to a heat exchanger for an internal combustion engine.

BACKGROUND

Heat exchangers for cooling recirculated exhaust gas are known from the prior art. In general, in the case of exhaust-gas cooling, there is the problem of the high chemical aggressiveness of the exhaust gas and the low pH value of its condensates. For this reason, only exhaust-gas heat exchangers produced from austenitic steels with high corrosion resistance have existed previously. Steels of said type result in high material costs and often further follow-up costs on account of the more complex machining operations. Furthermore, austenitic steels are usually poor heat conductors, such that heat exchangers with a predefined cooling power are of relatively large and heavy construction.

SUMMARY

It is the object of the invention to specify a heat exchanger for cooling exhaust gas or exhaust-gas/air mixture of an internal combustion engine, which heat exchanger can be produced at low cost.

As a result of at least a part of the heat exchanger being composed of ferritic steel, it is possible for costs to be saved on account of the usually relatively low prices for said steels.

In a preferred embodiment, the often better heat capacity of ferritic steels than austenitic steels is utilized to a particular extent in that the ferritic part of the heat exchanger is in contact with the fluid. Overall, therefore, a material-saving, weight-saving and cost-saving embodiment, of small construction, of a heat exchanger for exhaust-gas cooling is made possible as a result of the higher thermal conductivity of the ferritic steel.

The fluid is particularly preferably an in particular recirculated exhaust gas or exhaust-gas/air mixture of the internal combustion engine, with the fluid temperature in the first connecting region being more then 300° C., in particular more than 500° C., during normal operation. The risk of condensation of acidic condensate out of the exhaust gas is thereby reduced in the region of the entire heat exchanger.

In one preferred embodiment, the ferritic part of the heat exchanger corresponds substantially to the first connecting region and is welded to the exchanger region. The temperatures are particularly high specifically in the first connecting region, for which reason ferritic steels can be used in a relatively problem-free manner. In addition, ferritic steels usually have a lower coefficient of thermal expansion than austenitic steels, for which reason the combination of a ferritic connecting region with a subsequent austenitic exchanger region is particularly favorable with regard to expansion-related material stresses. In this context in particular, the first connecting region preferably has a flaring of a throughflow cross section in the direction of the exchanger region. An adjustable flap can also preferably be arranged in the connecting region. A distribution of the exhaust gas between a cooler region of a bypass duct can for example take place by means of the flap.

In a further preferred embodiment, the exchanger region has a plurality of exchanger tubes. Tube coolers are mechanically very stable and are expedient in particular in connection with a liquid coolant. For this purpose, the exchanger region expediently has an exchanger housing through which the liquid coolant can flow. Since the exchanger housing is often not in contact with the exhaust gas, it is particularly expedient for the exchanger housing to be composed of the ferritic steel, since even in the event of said exchanger housing rusting through, no liquid coolant passes into the combustion chambers of the engine.

In order to improve a heat exchanger power, the exchanger tubes can advantageously be composed of the ferritic steel, since said material has good thermal conductivity.

It can particularly advantageously be provided that a further part of the heat exchanger is composed of a further ferritic steel. There are ferritic steels with different levels of corrosion resistance and mechanical properties, which is often reflected in the material price. Depending on the extent to which the relevant part of the heat exchanger is subjected to corrosion or is involved in heat conduction, the different parts of a heat exchanger can be composed of different ferritic steels in order to optimize costs.

In a further preferred embodiment, the heat exchanger comprises a plurality of plate elements which are connected to one another in a stacked manner. A heat exchanger of said type is suitable in a particularly favorable manner as an exhaust-gas heat exchanger. Here, a fin element is advantageously arranged between the plate elements, which fin element is composed of the ferritic steel. On account of the design, corrosion of the fin element often does not result in the risk of a breakthrough of cooling liquid into the fluid region, which would otherwise lead to engine damage as a result of water shock. In particular separately insertable fin elements are therefore particularly predestined to be formed from ferritic steel. A fin element of said type can be arranged in the fluid to be cooled and/or in the coolant. If a fin element is arranged both in the fluid and also in the coolant, then said fin elements often differ in terms of design.

Here, a housing which encompasses the plate elements is particularly preferably provided, which housing is composed of the ferritic steel. Corrosion of the housing as a result of a long service life would not lead to a connection between the coolant and the exhaust gas, as a result of which the risk of engine damage is reduced. A housing of said type is a component of considerable size, in the case of which considerable costs can be saved by using ferritic steel. When using a sufficiently corrosion-resistant ferritic steel, the plate elements can however preferably also be composed of ferritic steel, which promotes the heat conduction and therefore the overall exchanger power for a given installation size.

A further part of the heat exchanger is generally preferably composed of an austenitic steel, as a result of which a material with a high level of corrosion resistance is used at least at critical points. The austenitic steel is preferably a steel from the group 1.4301 and 1.4404. These material designations correspond to the DIN EN 100 88-2 standard, to which all of the numbered material designations specified within the context of the present invention relate.

The part composed of ferritic steel and the part composed of austenitic steel are particularly preferably directly cohesively connected to one another by means of welding or soldering. A cohesive connection of said type, in particular a direct or autogenous welded connection or by means of a soldered connection, ensures a particular secure connection. Tests have shown that at least the ferritic and austenitic steels preferred for the heat exchanger construction can generally be cohesively connected to one another, in particular welded or soldered or adhesively bonded, without problems.

The ferritic steel is preferably a steel from the group 1.4006 and 1.4016. In the event of relatively low demands on corrosion resistance, the ferritic steel can preferably be a steel from the group 1.1169. 1.0461, 1.0462 and 1.0463, these being low-alloyed steels and fine-grain steels. Suitable higher-alloyed ferritic steels with at least 12% Cr content are preferable from the group 1.4000, 1.4002, 1.4006 and 1.4113. Higher-alloyed and stabilized steels (with titanium and niobium) are preferable from the group 1.4509, 1.4513, 1.4512 and 1.4520.

In a further preferred heat exchanger, the coolant is gaseous, in particular air. Exchangers of said type do not harbor the risk of water shock in the event of corrosion, and have particularly high demands with regard to heat conduction of the materials in order to obtain a suitable cooling capacity. The use of ferritic steels is therefore suitable.

A heat exchanger according to the invention can be arranged in a low-pressure branch downstream of an exhaust-gas turbine (low-pressure EGR). Lower mechanical loads and temperature differences occur in said arrangement. Heat exchangers can however also alternatively be arranged in a high-pressure branch upstream of an exhaust-gas turbine.

Further advantages and features of a heat exchanger according to the invention can be gathered from the exemplary embodiments described below.

BRIEF DESCRIPTION OF THE DRAWINGS

Below, two preferred exemplary embodiments of a heat exchanger according to the invention are described and explained in more detail on the basis of the appended drawings.

DETAILED DESCRIPTION

Figure 1:
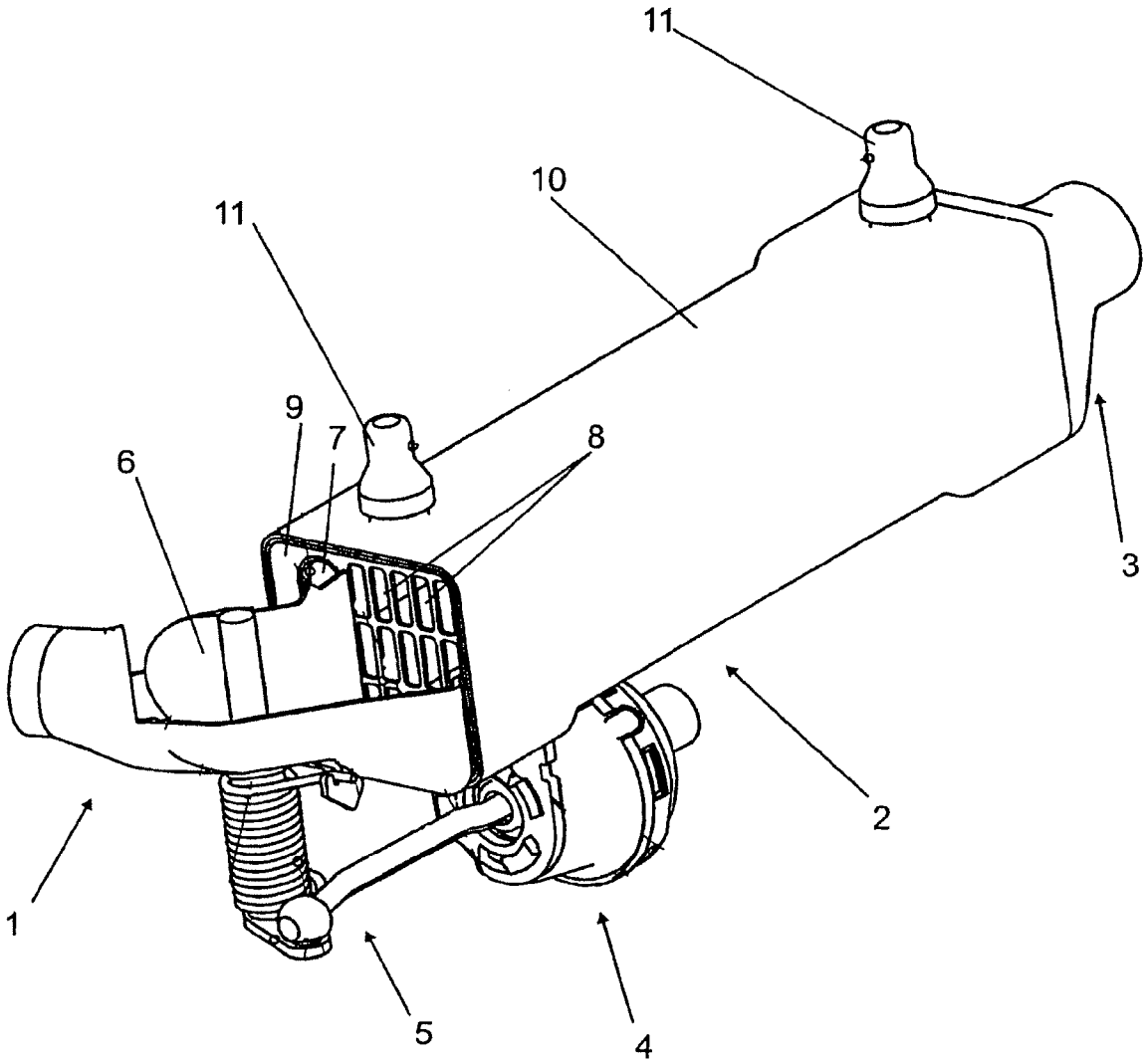
FIG. 1 shows a three-dimensional, partially cut-away view of a first exemplary embodiment of a heat exchanger according to the invention.

The exhaust-gas heat exchanger according to FIG. 1 is constructed according to the principle of a tube bundle exchanger. Said exhaust-gas heat exchanger has a first connecting region 1 for the supply of the exhaust gas (or exhaust-gas/air mixture), an exchanger region 2 in which the major part of the heat exchange takes place, and a second connecting region 3 for the discharge of the exhaust gas. An adjusting flap 6 which can be driven by means of an actuator 4 via a mechanism 5 is rotatably mounted in the first connecting region 1, by means of which adjusting flap 6 the exhaust-gas flow can be deflected in an adjustable manner between a bypass duct 7 and a bundle of heat exchanger tubes 8.

The bypass duct 7 and the exchanger tubes 8 are welded to one another by means of head elements 9, with an exchanger housing through which liquid coolant can flow also being formed by means of a housing casing 10 by welding to the head elements 9. Two connecting pipes 11 for conducting the liquid coolant through the exchanger housing are provided on the housing casing 10.

In the described heat exchanger, at least the first connecting region 1, which is composed of a housing which widens in the direction of the exchanger region 2, is composed of a ferritic steel, in particular the steel 1.4006 according to the DIN EN 100 27-2 standard. The housing casing 10 is expediently also formed from this steel.

Depending on the temperature range of the exhaust-gas flow, the latter being dependent inter alia on whether the cooler is inserted into a low-pressure or high-pressure exhaust-gas recirculation system, it is also possible for the exchanger tubes 8, the head elements 9 and also the second connecting region 3 to be composed of a ferritic steel. On account of the relatively high risk of condensation in the relatively cool region of the gas outlet, the second connecting region 3 is preferably produced from a ferritic steel rust-of resistant and stabilized quality, in particular 1.4512 or 1.4509. The exchanger tubes 8 and/or the bypass duct 7 and/or the head elements 9, in the event that these are composed of ferritic steel, are preferably produced so as to be of rust-resistant and stabilized quality (in particular 1.4512 and/or 1.4509).

In order to save costs, it is possible in particular for outer add-on parts such as for example retaining plates etc. to be composed of ferritic steel, in particular 1.1169, 1.0461, 1.0462 or 1.0463.

Figure 2:
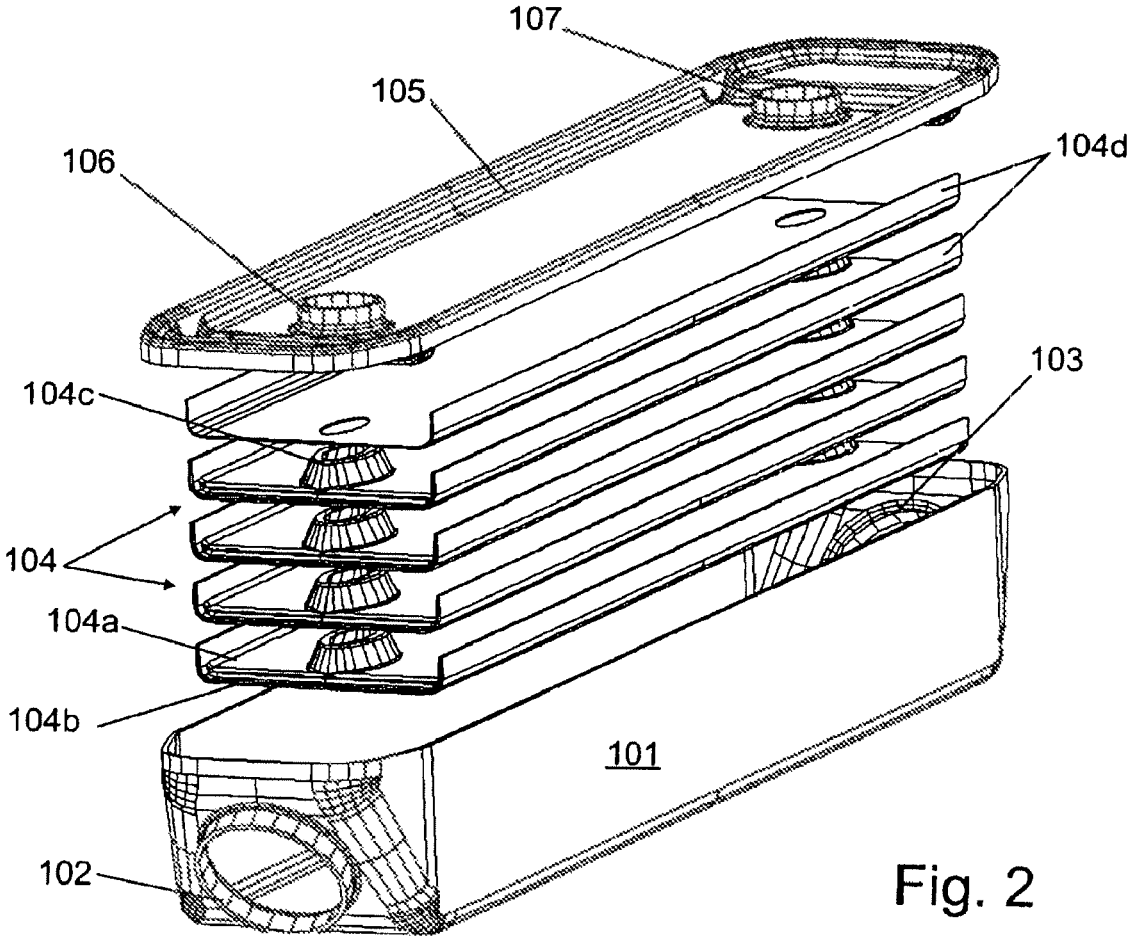
FIG. 2 shows a three-dimensional exploded illustration of a second exemplary embodiment of a heat exchanger.

The heat exchanger of the second exemplary embodiment (FIG. 2) is embodied as a plate-type heat exchanger. A number of plate elements 104 are arranged in an outer housing 101 which has a first connecting region 102 for the connection of a supply for the exhaust gas and a second connecting region 103 for the connection of a discharge for the exhaust gas. The housing 101 also comprises a closure cover 105 on which are provided connections 106, 107 for the connection of supply lines and discharge lines for a coolant. The plate elements 104 and regions of the housing 101 and cover 105 together form the exchanger region of the heat exchanger.

Each of the plate elements 104 is constructed from two plates 104*a*, 104*b*, with a fin element 108 being provided between the plates 104, 104*b*. The in each case upper plate 104*a* has a pipe-like arched portion 104*c* which adjoins the edge of an aperture of the lower plate of the subsequent plate element. The individual pipes 104*c* of the plate elements are aligned with one another and with the connections 106, 107 of the cover 105. The plate element 104 which is furthest remote from the cover has a lower plate 104*b* which has no apertures. In this way, a cavity through which the liquid coolant can flow is formed by the number of intermediate spaces between the in each case upper plate 104*a* and lower plate 104*b*, with edge-side delimitations of the cavities being formed by welding the turned-up edges 104*d* of the plates 104*a*, 104*b* to one another.

The coolant flows in each of the plate elements between the one pipe which is assigned to the connection 106 and the other pipe which is assigned to the connection 107. Here, the fins 108 around which the coolant flows ensure an additionally improved exchange of heat between the coolant and the plates, with turbulence of the coolant being generated in particular.

The intermediate space, defined primarily by the height of the pipe 104*c*, between two adjacent plate elements 104 is in each case open at the end side of the plate elements to the connecting regions 102, 103 of the housing 101 of the heat exchanger. The exhaust gas flows through said intermediate spaces, with said exhaust gas being cooled on the large-area plate elements 104*a* which are cooled by the coolant.

Figure 3:
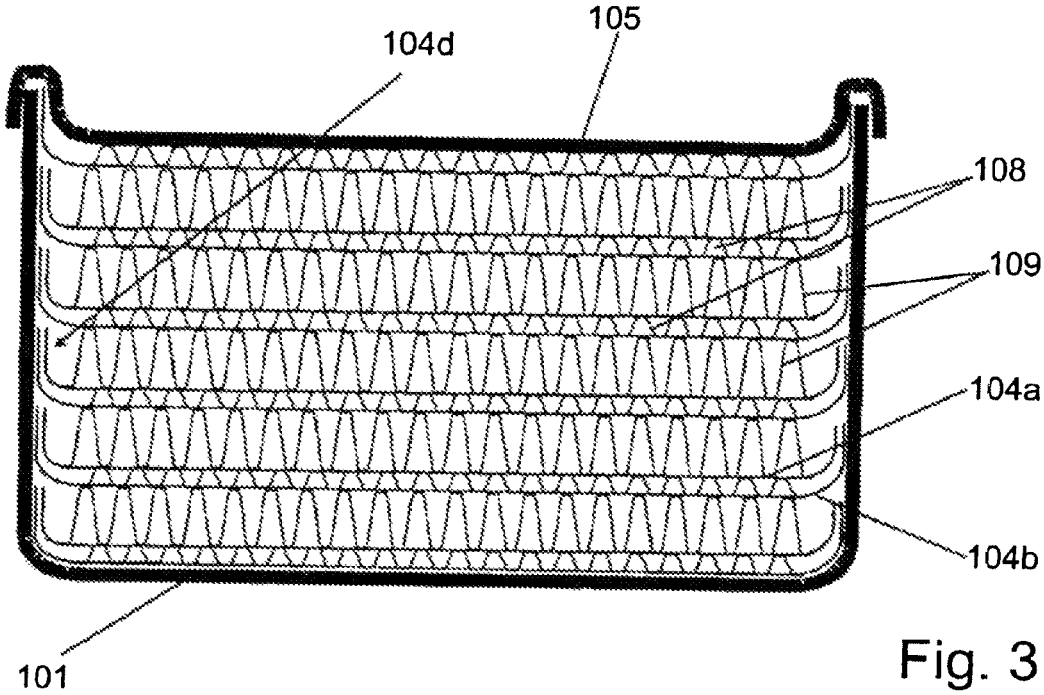
FIG. 3 shows a schematic section view through a fully-assembled heat exchanger according to FIG. 2.

For the mechanical stability and for the cooling the housing 101, the longitudinal-side edge regions 104*d* of the plate elements 104 are turned up and bear flat against the inner wall of the housing 101 in regions (see in particular FIG. 3). In particular, a welded or soldered connection of the plate elements 104 to the inner wall of the housing 101 is provided so as to cover as large an area as possible, such that the housing 101 is provided with a sufficient cooling capacity.

The housing 101 is preferably produced from a ferritic steel. The latter can in particular be a cost-effective steel such as for example 1.1169, 1.0461, 1.0462 and 1.0463. In the event of corrosion of the housing part 101, there would be no discharge of liquid coolant into the exhaust gas, for which reason the use of a cheaper material is permitted in the interests of a cost-risk trade-off.

In order to improve the exchanger capacity, and therefore also in order to reduce the installation size for a given exchanger capacity, the plate stack 104 and also the cover 105 can be composed of a ferritic steel. Since said elements generate a separation between the exhaust gas and the liquid coolant, the ferritic steel is preferably a particularly corrosion-resistant type, for example 1.4000, 1.4002 or 1.4113 or else a high-value ferritic steel such as 1.4513 or 1.4520.

As shown in FIG. 3, fin elements 109 can also be arranged between the plate elements 104, around which fin elements 109 the exhaust gas flows and which fin elements 109 therefore provide an enlarged exchanger surface. Said fin elements 109 can also be composed of ferritic steel.

The invention claimed is:

1. A heat exchanger for an internal combustion engine, comprising:

a first connecting region configured to supply a fluid to be cooled, wherein the fluid at least proportionately comprises exhaust gas of the internal combustion engine, a second connecting region configured to discharge the fluid, and an exchanger region arranged between the first connecting region and the second connecting region with regard to a flow path of the fluid, wherein the heat exchanger is configured such that a coolant flows around the exchanger region, wherein at least a part of the heat exchanger comprises ferritic steel and a further part of the heat exchanger comprises an austenitic steel.

2. The heat exchanger as claimed in claim 1, wherein the ferritic steel is in contact with the fluid.

3. The heat exchanger as claimed in claim 1, wherein the first connecting region has a flaring of a throughflow cross section in the exchanger region.

4. The heat exchanger as claimed in claim 1, wherein an adjustable flap is arranged in the first connecting region.

5. The heat exchanger as claimed in claim 1, wherein another of the heat exchanger comprises a further ferritic steel.

6. The heat exchanger as claimed in claim 1, wherein the austenitic steel is a steel from the group 1.4301 and 1.4404, designations according to DIN EN 100 88-2.

7. The heat exchanger as claimed in claim 1, wherein the part comprising ferritic steel and the further part comprising of austenitic steel are directly cohesively connected to one another.

8. The heat exchanger as claimed in claim 1, wherein the ferritic steel is a steel from the group consisting of 1.4006 and 1.4016.

9. The heat exchanger as claimed in claim 1, wherein the ferritic steel is a steel from the group consisting of 1.1169, 1.0461, 1.0462 and 1.0463.

10. The heat exchanger as claimed in claim 1, wherein the ferritic steel is a steel from the group consisting of 1.4000, 1.4002 and 1.4113.

11. The heat exchanger as claimed in claim 1, wherein the ferritic steel is a steel from the group consisting of 1.4513 and 1.4520.

12. The heat exchanger as claimed in claim 1, wherein the heat exchanger is arranged in a low-pressure branch downstream of an exhaust-gas turbine.

13. The heat exchanger as claimed in claim 1, wherein the heat exchanger is arranged in a high-pressure branch upstream of an exhaust-gas turbine.

14. The heat exchanger as claimed in claim 1, wherein the first connecting region comprises the ferritic steel and the exchanger region comprises the austenitic steel.

15. The heat exchanger as claimed in claim 1, wherein the fluid is recirculated exhaust gas or an exhaust-gas/air mixture of the internal combustion engine, with a fluid temperature in the first connecting region being more than 300° C. during normal operation.

16. The heat exchanger as claimed in claim 15, wherein the fluid temperature in the first connecting region is more than 500° C. during normal operation.

17. The heat exchanger as claimed in claim 1, wherein the ferritic steel part of the heat exchanger corresponds substantially to the first connecting region and can be connected in a cohesive fashion to the exchanger region.

18. The heat exchanger as claimed in claim 17, wherein the ferritic steel part of the heat exchanger is welded, soldered, or adhesively bonded to the exchanger.

19. The heat exchanger as claimed in claim 1, wherein the coolant is gaseous.

20. The heat exchanger as claimed in claim 19, wherein the coolant is air.

21. The heat exchanger as claimed in claim 1, wherein the exchanger region-has a plurality of exchanger tubes.

22. The heat exchanger as claimed in claim 21, wherein the exchanger tubes comprise the ferritic steel.

23. The heat exchanger as claimed in claim 21, wherein the exchanger region has an exchanger housing through which the coolant can flow.

24. The heat exchanger as claimed in claim 23, wherein the exchanger housing at least partially comprises the ferritic steel.

25. The heat exchanger as claimed in claim 1, wherein the heat exchanger comprises a plurality of plate elements which are connected to one another in a stacked manner.

26. The heat exchanger as claimed in claim 25, further comprising a housing which encompasses the plate elements is provided, wherein the housing comprises the ferritic steel.

27. The heat exchanger as claimed in claim 25, wherein a fin element for increasing an area of thermal contact is arranged between the plate elements, with the fin element comprising the ferritic steel.

28. The heat exchanger as claimed in claim 27, wherein the fin element is arranged in the fluid to be cooled.

29. The heat exchanger as claimed in claim 27, wherein the fin element is arranged in the coolant.

* * * * *